US005753889A

United States Patent [19]

Kondo et al.

[11] Patent Number: 5,753,889

[45] Date of Patent: May 19, 1998

[54] IMAGE HEATING APPARATUS AND HEATER WITH MULTI-LAYER ELECTRODES

[75] Inventors: Hiroshi Kondo; Kazuki Miyamoto, both of Yokohama, Japan

[73] Assignee: Canon Kabushiki Kaisha, Tokyo, Japan

[21] Appl. No.: 757,083

[22] Filed: Nov. 26, 1996

Related U.S. Application Data

[63] Continuation of Ser. No. 113,061, Aug. 30, 1993, abandoned.

[30] Foreign Application Priority Data

Sep. 1, 1992 [JP] Japan ..... 4-233691

[51] Int. Cl.[6] ..... G03G 15/20; H05B 3/03

[52] U.S. Cl. ..... 219/216; 219/541; 219/543; 399/329

[58] Field of Search ..... 219/216, 244, 219/457, 541, 543; 338/307, 308, 309; 399/329, 328

[56] References Cited

U.S. PATENT DOCUMENTS

| | | | |
|---|---|---|---|
| 2,648,754 | 7/1953 | Lytle | 219/541 |
| 3,931,496 | 1/1976 | Hurko | 219/543 |
| 4,690,872 | 9/1987 | Kato et al. . | |
| 5,000,662 | 3/1991 | Yamamoto et al. | 338/308 |
| 5,068,517 | 11/1991 | Tsuyuki et al. | 219/543 |
| 5,083,168 | 1/1992 | Kusaka et al. . | |
| 5,091,752 | 2/1992 | Okada | 355/285 |
| 5,149,941 | 9/1992 | Hirabayashi et al. | 219/216 |
| 5,162,634 | 11/1992 | Kusaka et al. | 219/216 |
| 5,241,155 | 8/1993 | Koh et al. | 219/216 |
| 5,343,021 | 8/1994 | Sato et al. | 219/541 |

FOREIGN PATENT DOCUMENTS

| | | |
|---|---|---|
| 360418 | 3/1990 | European Pat. Off. . |
| 372479 | 6/1990 | European Pat. Off. . |
| 486890 | 5/1992 | European Pat. Off. . |
| 488357 | 6/1992 | European Pat. Off. . |

*Primary Examiner*—Teresa J. Walberg
*Assistant Examiner*—Gregory L. Mills
*Attorney, Agent, or Firm*—Fitzpatrick, Cella, Harper & Scinto

[57] ABSTRACT

An image heating apparatus includes a heater includes an electrically insulating base plate, an electrically resistive layer, on the base plate, for generating heat when supplied with electrical power, and a terminal electrode for connection with the resistance layer, including a silver alloy layer, and a conductive layer having a lower resistance value than the silver alloy layer; a film for transmitting the heat from the heater to heat an image on a recording material while being moved together with the recording material, sliding on the heater; and a power supply connector press-contacted to the silver alloy layer with a predetermined contact pressure.

13 Claims, 8 Drawing Sheets

IMAGE HEATING APPARATUS AND HEATER WITH MULTI-LAYER ELECTRODES

This application is a continuation of U.S. application Ser. No. 08/113,061 filed Aug. 30, 1993, now abandoned.

FIELD OF THE INVENTION AND RELATED ART

The present invention relates to an image heating apparatus or heater to be preferably incorporated in a thermal fixing member of an image forming apparatus such as copying machine or electrophotographic printer.

As a fixing apparatus to be used in the image forming apparatus, a fixing apparatus incorporating a heat roller system has been widely used. However, according to recent U.S. Pat. Nos. 5,149,941 and 5,162,634, or the like, a fixing apparatus incorporating a film heating system has been devised, which comprises a ceramic heater and a thin piece of film.

A heater to be used in such a film heating system is shown in FIG. 12.

A reference numeral 1 designates a heater (heating member) comprising:

(a) long and narrow base plate 2 which is electrically insulating and heat resistant, and has a low thermal capacity;

(b) narrow straight strip of heat generating resistor 3 disposed on one (top surface) of the surfaces of the base plate 2, extending along the lateral center line;

(c) terminal electrodes 4 and 5 (connecting terminals) being disposed on the base plate and connected to respective ends of the heat generating resistor;

(d) electrically insulating overcoat layer 6 of glass or the like, covering the heat generating resistor 3 and the base plate 2 surface on which the heat generating resistor is formed, as a protective layer for the heater surface.

(e) temperature detecting element 7 such as a thermistor, disposed on the other surface (underside) of the base plate 2.

The base plate 2 is a ceramic plate made of $Al_2O_3$, AlN, SiC, or the like, measuring, for example, 10 mm wide, 1 mm thick, and 240 mm long.

The heat generating resistor 3 is a thin patterned layer of Ag/Pd (palladium/silver alloy), $RuO_2$, $Ta_2N$, or the like, which is coated on the base plate 2 by a screen printing process or the like, and is baked in the atmosphere, and measures, for example, 10 μm thick and 1 mm wide.

The terminal electrodes 4 and 5 are generally structured in patterned layers of Ag which are formed by coating paste of Ag using the screen printing process or the like, and baking it in the atmosphere. They measure 10 μm in thickness. The power is supplied to the heater by connecting electrical wires to the terminal electrodes 4 and 5.

FIG. 13 is a sectional view of an embodiment in which the power is supplied through a detachable connector.

In such a film heating system, the amount of heat generated by the heater 3 is increased in order to increase the fixing speed, in other words, the current flowed through the resistor must be increased.

However, the increased current brings about a large temperature increase (temperature increase is proportional to $I^2R$, that is, proportional to the square of the current. For example, when a current of 12 A is flowing, the saturation temperature ranges from 100° C. to 150° C.). Therefore, the springy material (generally, phosphor bronze) which forms the connectors deteriorates because of the high temperature creep. As a result, the contact pressure is reduced and the contact resistance value increases, which further increases the temperature. In other words, a thermal runaway is triggered, which causes reliability of the connecting members, that is, the reliability of the apparatus, to be questionable.

In this case, the amount of the heat generation is related to the resistance value of the connector itself and the resistance value of the terminal electrode, wherein the resistance value of the connector made of phosphor bronze is 0.5 mΩ, and the resistance value of the terminal electrode made of Ag/Pt alloy is 15 mΩ when the distance between the tip of the connector and the tip of the heat generating resistor is approximately 20 mm, and the film thickness of Ag/Pt is 10 μm.

Therefore, in order to suppress the abnormal heat generation, it is necessary to reduce the resistance value of the terminal electrode.

It is conceivable to use, as the material for the terminal electrode, Ag or the like which has less resistivity, instead of Ag/Pt alloy which has higher resistivity. However, generally speaking, such a pure metal has less hardness (is softer) than an alloy. Therefore, when it is subjected to a mechanical contact pressure as it is in the connector, its contact surface suffers from plastic deformation, whereby the connection becomes unstable, causing thereby such a problem that the contact resistance value increases. When a connector was plugged into and out of two types of terminal electrodes as shown in FIG. 14, one formed of Ag/Pt alloy and the other formed of pure Ag, the contact resistance value hardly changes in the case of the Ag/Pt alloy having a higher film hardness, but, in contrast, it gradually increased as plugging and unplugging continued, in the case of the pure Ag having a lower film hardness.

Such contact resistance value changes caused as the connector surface and the terminal electrode surface rub against each other has been confirmed by a reliability test such as the heat cycle test.

As is evident from the above descriptions, it was not possible up to now to reduce the resistance value of the terminal electrode in order to suppress the abnormal heat generation, while maintaining satisfactorily a stable connection to the connector.

On the other hand, when the connection is effected by soldering, the Ag forming the terminal electrode is eaten (diffused in) in the solder, causing the terminal electrode to become thinner. Further, in the high temperature condition after the soldering, the connection strength is deteriorated by the diffusion of the Ag. In addition, when the heater generates heat, the temperature in this type of heating apparatus reaches as high as 100° C. to 150° C. (when 12 A is flowed) even at the terminal electrode. Therefore, it is necessary to use a solder having a higher melting point than an ordinary eutectic solder (melting point: 183° C.), whereby the amount of the Ag eaten during a soldering operation increases. As a result, if the more heat resistant solder having a high melting point is used, the terminal electrode may disappear.

SUMMARY OF THE INVENTION

Accordingly, a principle object of the present invention is to provide a heater and an image heating apparatus, in which the abnormal amount of heat generated at the terminal electrode is reduced.

Another object of the present invention is to provide a heater and an image heating apparatus, in which the contact resistance of the terminal electrode is prevented from changing.

According to an aspect of the present invention, a heater and an image heating apparatus according to the present invention comprises an electrically insulating base plate, a resistive layer which is disposed on the base plate and generates heat when supplied with the power, and terminal electrodes for supplying the power to the resistive layer, comprising a silver alloy layer and a conductive layer having a resistance value lower than that of the silver alloy layer.

These and other objects, features and advantages of the present invention will become more apparent upon a consideration of the following description of the preferred embodiments of the present invention taken in conjunction with the accompanying drawings.

DESCRIPTION OF EMBODIMENTS

Figure 10:
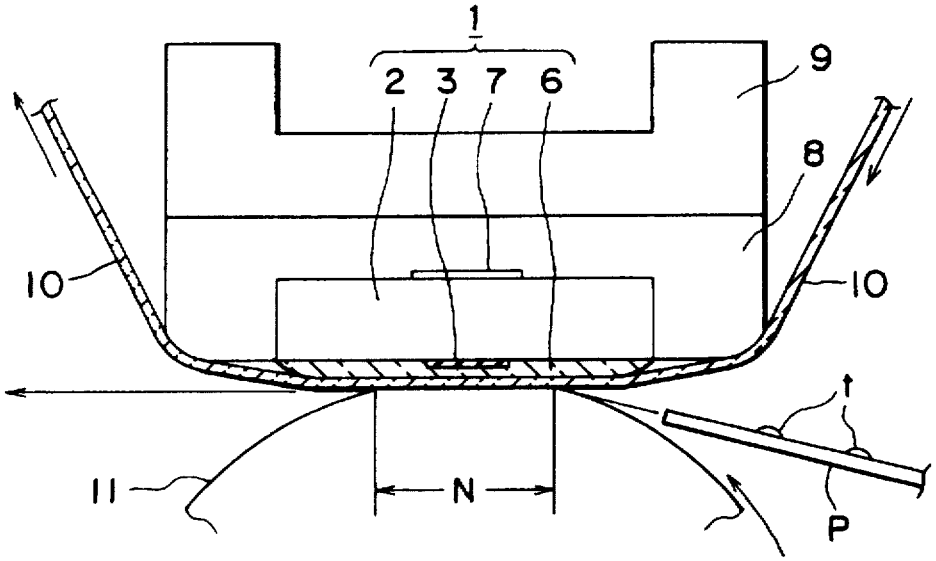
FIG. 10 is an enlarged sectional view of a portion of a fixing apparatus incorporating one of the embodiments of the present invention.
Figure 11:
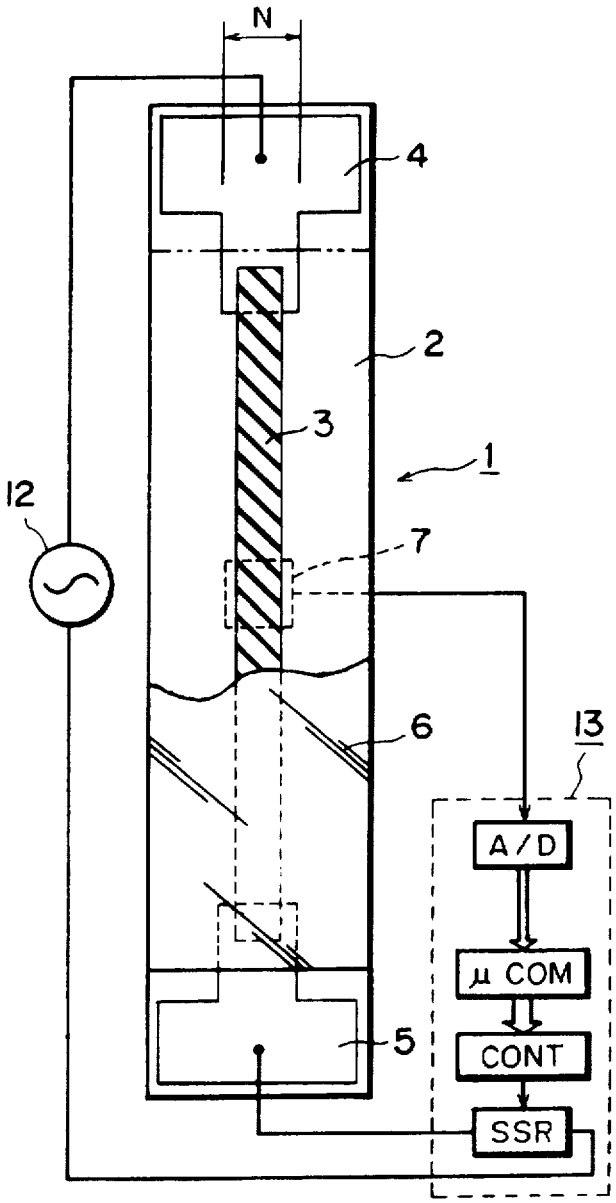
FIG. 11 is a plan view of the top surface of the embodiment of heater in accordance with the present invention.
Figure 12:
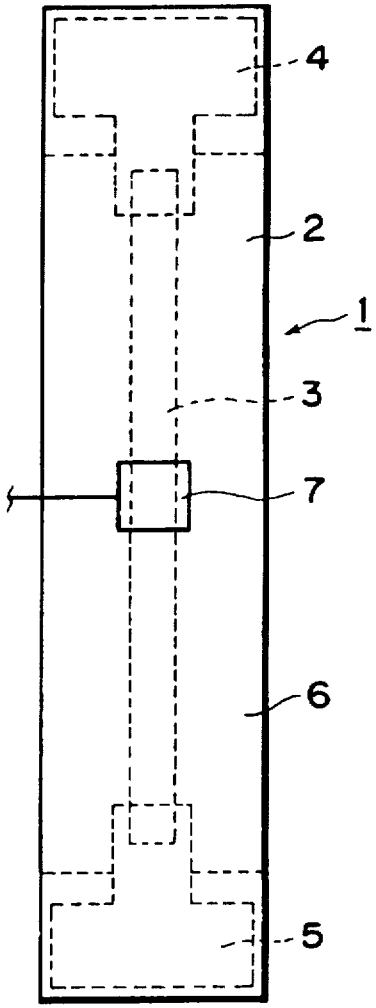
FIG. 12 is a plan view of the top surface of a prior heater.
Figure 13:
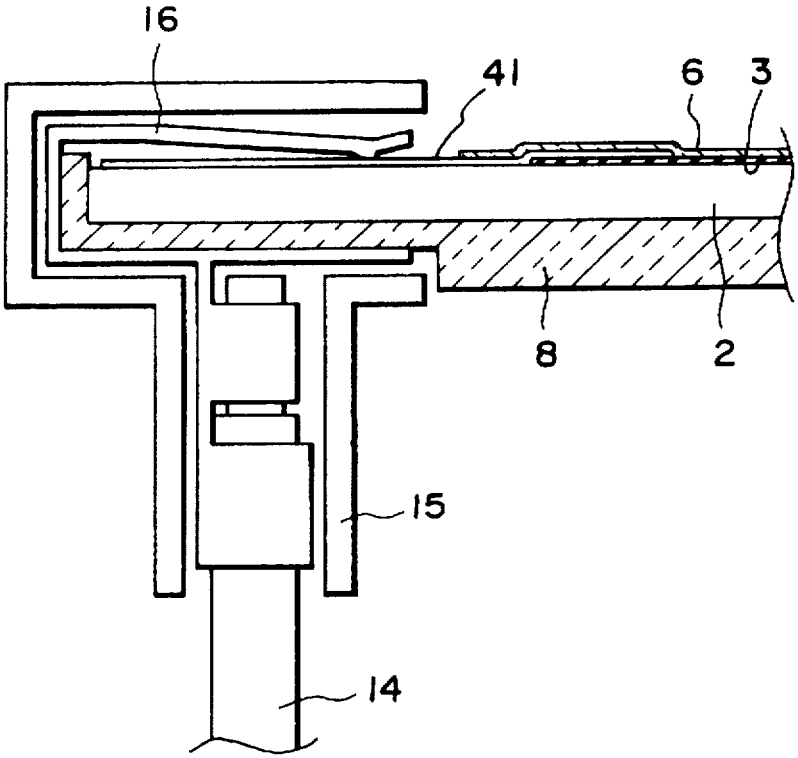
FIG. 13 is a schematic sectional view of an embodiment of connector for supplying the power to the heater.
Figure 14:
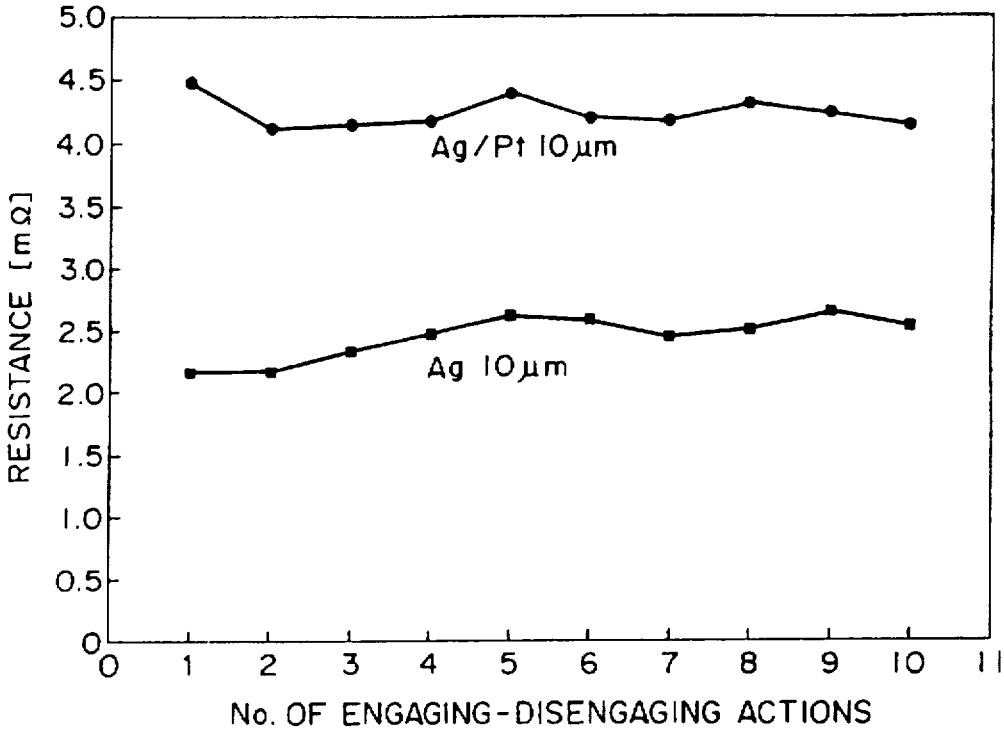
FIG. 14 is a graph showing the results of contact resistance value changes obtained by a plugging-unplugging test.

FIG. 10 is an enlarged sectional view of a portion of a fixing apparatus, that is, an image heating apparatus, of the film heating apparatus incorporating the embodiment of the heater in accordance with the present invention, and FIG. 11 is a plan view of the embodiment of heater in accordance with the present invention.

A heater 1 comprises a base plate 2, an heat generating resistor 3, a temperature sensor 7, and an overcoat layer 6. In order to enable the heater 1 to best control the fixing surface temperature of the apparatus, the heat generating resistor 3 is substantially centered as shown in FIG. 10, across a fixing nip N (pressure contact nip or pressuring member) which will be described hereinafter.

The heater surface on the overcoat layer 6 side serves as the surface on which the film slides, and this side is exposed when the heater is fixed on a heater supporting member 9, with use of a thermally insulating heater holder 8.

A reference numeral 10 designates an endless belt, or a long web, of heat resistant film of polyimide or the like, measuring approximately 40 μm in thickness, and a reference numeral 11 designates a pressure roller as the pressuring member for pressuring this film onto the heater 1.

The film 1 is driven by an unshown driving member or by the rotation of the pressure roller 11, in the direction indicated by an arrow at a predetermined speed, while sliding on the surface of the heater 1 without losing contact with the heater 1.

When a voltage from an AC power source 12 is applied between terminal electrode 4 disposed at one end of the heat generating resistor 3 and the terminal electrode 5 disposed at the other end, the heat generating resistor 3 generates heat, whereby the heater 1 increases its temperature.

The temperature of the heater 1 is detected by the temperature detecting element 7 disposed on the back side of the base plate, and the detected data are fed back to a power supply control circuit 13 to be used for controlling the power supplied to the heat generating resistor 3, whereby the heater 1 temperature is maintained at a predetermined level.

The temperature detecting element 7 of the heater 1 is disposed on the bottom side surface of the base plate, at a location where its thermal response to the fixing surface temperature is the best, in other words, at a location which is directly below where the heat generating resistor 3 is disposed on the top surface of the base plate.

After the heater 1 temperature is increased to a predetermined level by supplying the power to the heat generating resistor 3, a recording material P carrying an unfixed toner image is introduced into the fixing nip N in which the film 10 is driven together with the recording material P. While the recording material moves through the fixing nip, being tightly pressed on the film, thermal energy is transferred from the heater 1 to the recording material P, through the film 10, whereby the unfixed toner image t borne on the recording material P is thermally fused, that is, fixed onto the recording material P.

Figure 1:
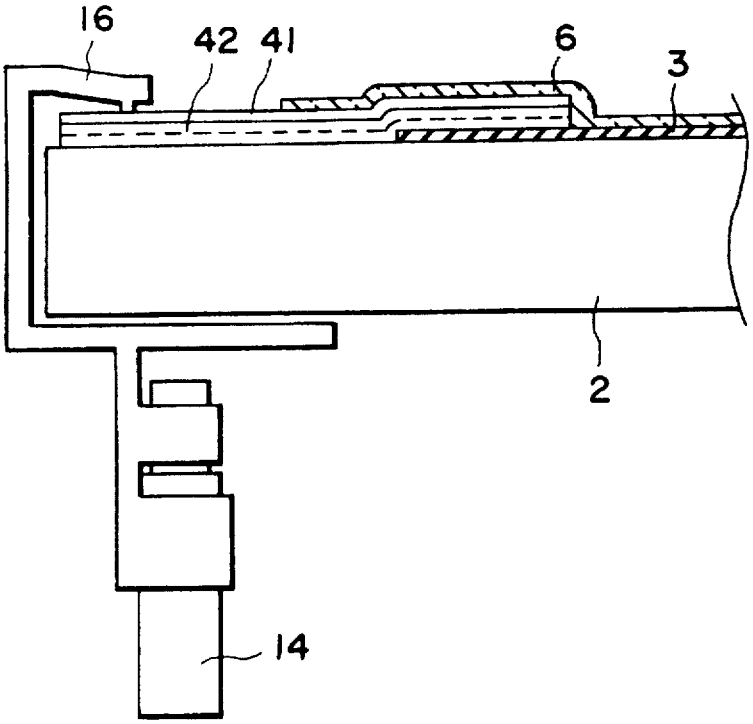
FIG. 1 is a schematic sectional view of a preferred embodiment of the present invention.

FIG. 1 is a schematic sectional view of the preferred embodiment of the terminal electrode and the adjacent components. In the figure, a reference numeral 2 designates a base plate; 3, a heat generating resistor formed of Ag/Pd; 41, a contact layer of Ag/Pt; 42, a conductive layer of Ag; 6, an overcoat layer of glass or the like; 14, a wire; and a reference numeral 16 designates a connector contact (springy metal). Incidentally, a connector housing and the heater holder are omitted for the sake of simplicity.

In this embodiment, first, a pattern of paste containing Ag/Pd is printed on the ceramic base plate 2 to form the heat generating resistor 3, and the printed pattern is partially baked. Next, a pattern of silicon paste is printed to form a conductive layer 42 in a manner to cover the tip of the heat generating resistor 3 and the printed pattern is partially baked, and the silver paste is printed again, using the same mask, and it is partially baked, to provide the conductive layer 42. Next, a pattern of silver alloy paste containing Ag/Pt is printed on the conductive layer 42, using the same mask as the one used for forming the conductive layer 42, and is partially baked. Then, after the protective glass layer 6 is printed, the final and complete baking is carried out to finish the heater 1.

According to this embodiment, the terminal electrode which supplies the heat generating resistor 3 with a current by contacting the connector contact 16 has multiple layers: the contact layer 41 of silver alloy, which is relatively hard, the conductive layer 42 of silver, which has low resistivity and is relatively thick, and other layers, wherein the connector contact 16 comes in contact only with the contact layer 41 when the terminal electrode is plugged in or unplugged from the connector, or the two components rub against each other. Therefore, the contact resistance value is not affected by the repeated plugging-unplugging, or rubbing between the two components.

The resistance value of the conductive layer 42 laid below the contact layer 41 is extremely low because of a relatively large thickness of the conductive layer, in addition to the low resistivity of its material.

Therefore, it is possible to allow a large current to flow while suppressing the abnormal heat generation at the terminal electrode, which in turn prevents the deterioration of the connect contact 16 caused by the high temperature creep. Further, the amount of thermal expansion of the contact 16 and the terminal electrode, which is caused by the rising temperature of the terminal electrode, is reduced, in other words, the magnitude of relative sliding between two components is reduced, assuring thereby more reliable contact between two components.

Figure 2:
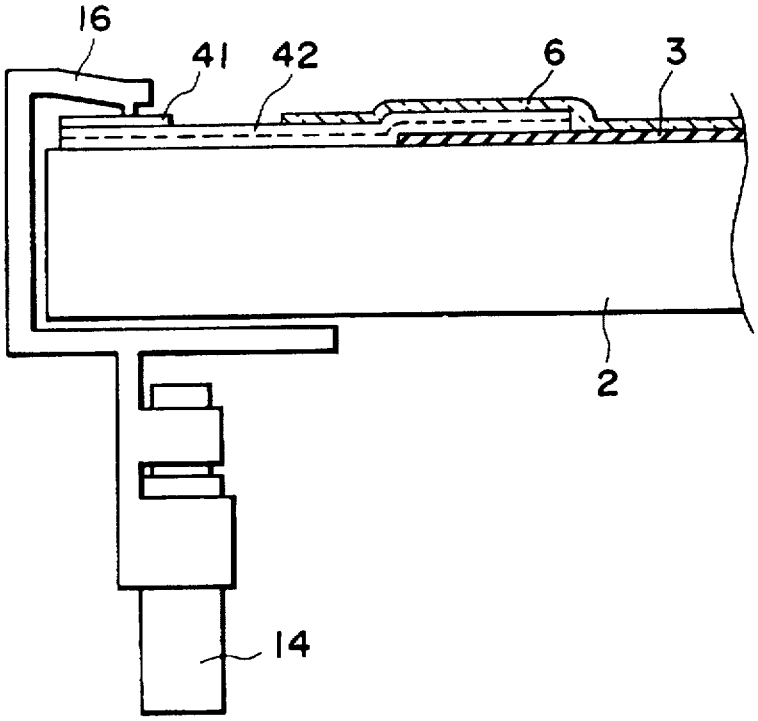
FIG. 2 is a schematic sectional view of an alternative embodiment of the present invention.

The contact layer 41 of the silver alloy may be printed as shown in FIG. 2, wherein the contact layer 41 is formed only where the connector contact 16 comes in contact with it. This arrangement offers the same results.

Embodiment 2

Figure 3:
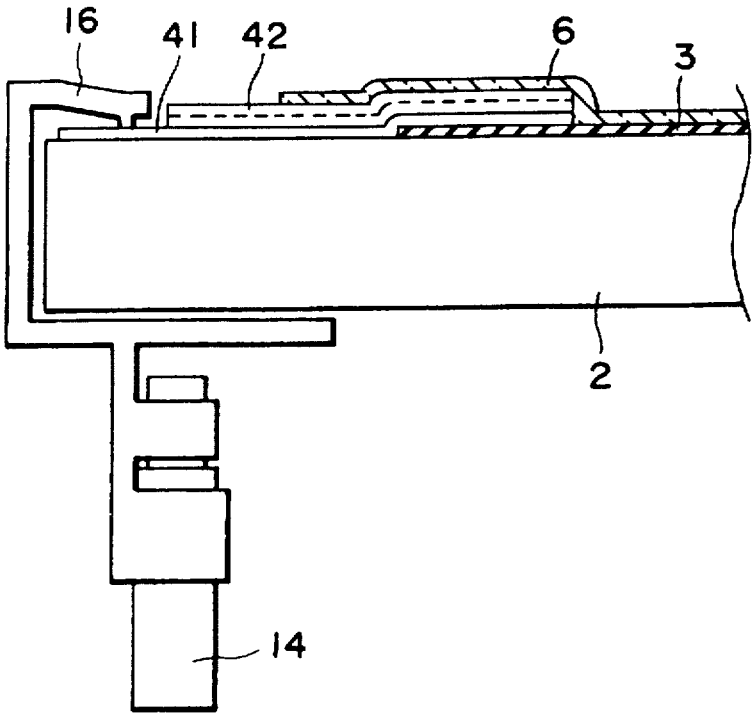
FIG. 3 is a schematic sectional view of the second embodiment of the present invention.

FIG. 3 is a schematic sectional view of the second embodiment, showing the terminal electrode and its adjacent components. In this figure, a reference numeral 2 designates a ceramic base plate; 3, a heat generating resistor of Ag/Pd; 41, a contact layer of Ag/Pt; 42, a conductive layer of Ag; 6, an overcoat layer of glass; 14, a wire; and a reference numeral 16 designates a connector contact (springy metal). The connector housing and heater holder are omitted from the drawing for the sake of simplicity.

Figure 4:
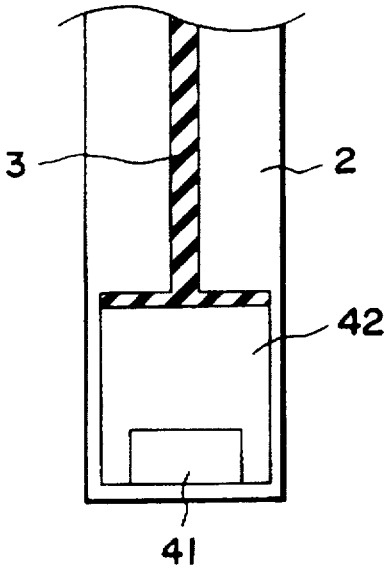
FIG. 4 is a schematic sectional view of an alternative embodiment of the present invention.

In this embodiment, the manufacturing process is the same as the prior one, up to the step where the heat generating resistor 3, and the terminal electrode 41 containing the prior material, that is, Ag/Pt alloy, are printed on the ceramic base plate 2. Next, the Ag paste having low resistivity is printed on the Ag/Pt alloy layer to a predetermined thickness, using a mask prepared to exclude the area where the connector contact 16 comes in contact with during and after plugging in, and then, is baked, forming thereby the conductive layer 42 on the Ag/Pt alloy layer. With regards to the area where the conductive layer 42 is formed, if the contact 16 comes in contact with the terminal electrode only at the central portion the terminal electrode, the conductive layer 42 may be formed on both sides of it as shown in FIG. 4. Then, the protective glass layer 6 is formed as shown in the drawings.

In this embodiment, the contact layer 41 is formed directly on the ceramic base plate 2, eliminating the chance that the rigidity of the contact layer 41 is influenced by the underlying metallic layers. Therefore, the contact between two components is more reliable, that is, less susceptible to the wear or deformation which occurs when two components are connected or disconnected, or which occurs as two components rub against each other. Further, since the conductive layer 42 is formed to cover the immediately adjacent area of where the connector 16 comes in contact with the heater 1, the resistance value between the connector contact and the heat generating resistor 3 is reduced, which in turn reduces the excessive heat generation when the large current is allowed to flow.

Figure 5:
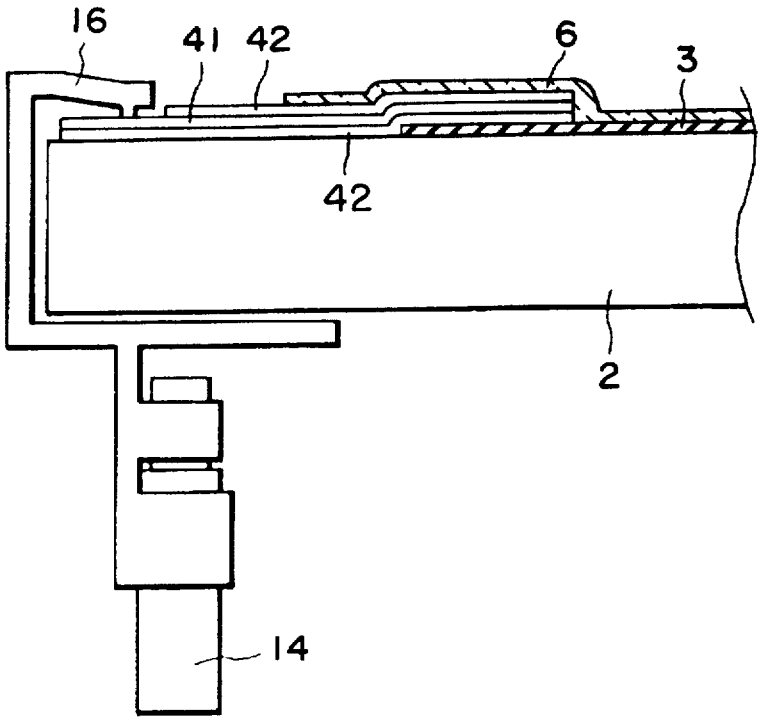
FIG. 5 is a schematic sectional view of the third embodiment of the present invention.

FIG. 5 is a schematic sectional view of the third embodiment, showing the terminal electrode and its adjacent components. In this drawing, a reference numeral 2 designates a ceramic base plate; 3, a heat generating resistor of Ag/Pd; 41, a contact layer of Ag/Pt; 42, a conductive layer of Ag; 6, a overcoat layer of glass; 14, a wire; and a reference numeral 16 designates a connector contact (springy metal). The connector housing and heater holder are omitted from the drawing for the sake of simplicity.

In this embodiment, the conductive layer 42 of the silver paste is printed on the ceramic base plate 2, and on top of it, the contact layer 41 of the Ag/Pt paste is printed using the same mask as the one used for the conductive layer 42. Then, the silver paste is again used to print the conductive layer 42 on the contact layer 41, using this time a mask covering the area where the connector 16 comes in contact with it, constructing a terminal electrode structure in which the contact layer 41 is sandwiched between the conductor layers 42.

Since the terminal electrode is structure as described above, a current supplied to the contact layer 41 spreads over the conductive layers 42 formed on both surface of the contact layer 41 and flows into the heat generating resistor 3. In other words, the sandwich structure increases the size of the contact surface area between the contact layer 41 and the conductive layer 42, reducing thereby the resistance value at the interface between the two components.

Figure 6:
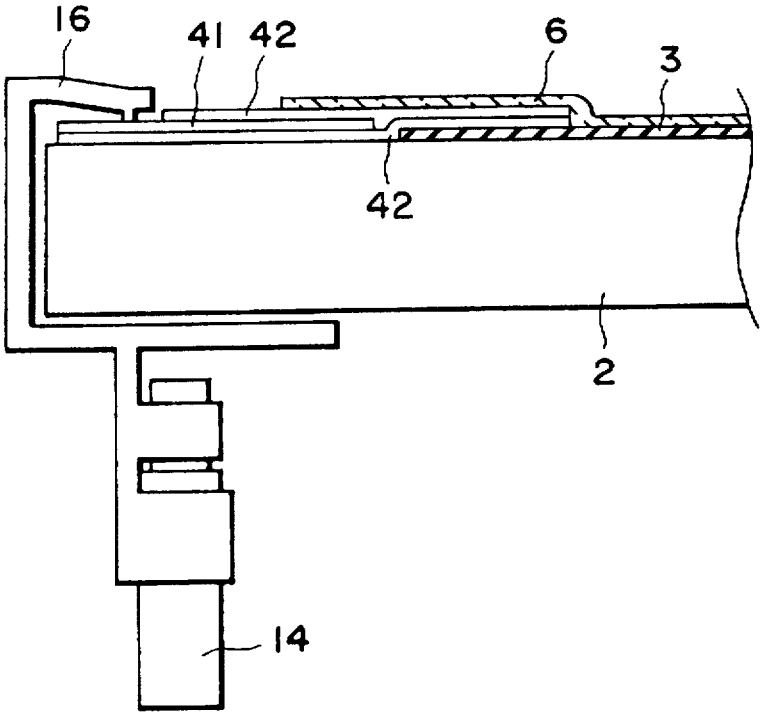
FIG. 6 is a schematic sectional view of an alternative embodiment of the present invention.

Referring to FIG. 6, the contact layer 41 is printed using a mask different from what is used for printing the underlying conductive layer 42, so that the contact layer 41 does not reach as far as the tip of the heat generating resistor 3, and then, overlying conductive layer 42 is printed to cover both layers. This structure reduces the thickness of the area where the multiple layers overlap at the tip of the heat generating resistor 3, and therefore, the step created by the accumulated layers is better covered by the protective glass layer, which improves the reliability in terms of the voltage resistance.

Embodiment 4

Figure 7:
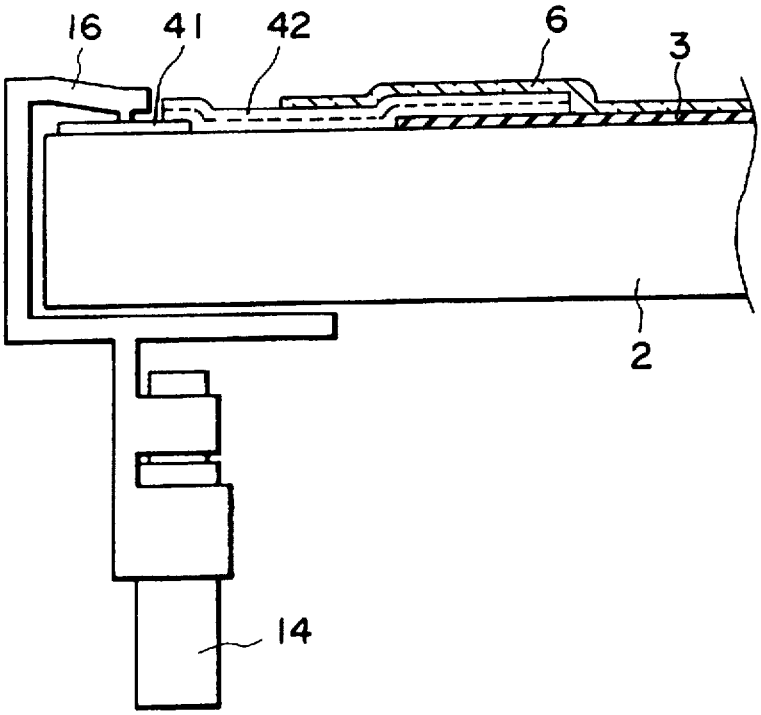
FIG. 7 is a schematic sectional view of the fourth embodiment of the present invention.

FIG. 7 is a schematic sectional view of the fourth embodiment. In this drawing, a reference numeral 2 designates a ceramic base plate; 3, a heat generating resistor of Ag/Pd; 41, a contact layer of Ag/Pt; 42, a conductive layer of Ag; 6, an overcoat layer of glass; 14, a wire; and a reference numeral 16 designates a connector contact (springy metal). The connector housing and heater holder are omitted from the drawing for the sake of simplicity.

In this embodiment, the contact layer 41 is printed on the ceramic base plate 21, only where the connector contact 16 comes in contact with it. The interval between the contact layer 41 and the heat generating resistor 3 is covered by the conductive layer 42 of silver paste printed in multiple layers.

Embodiment 5

Figure 8:
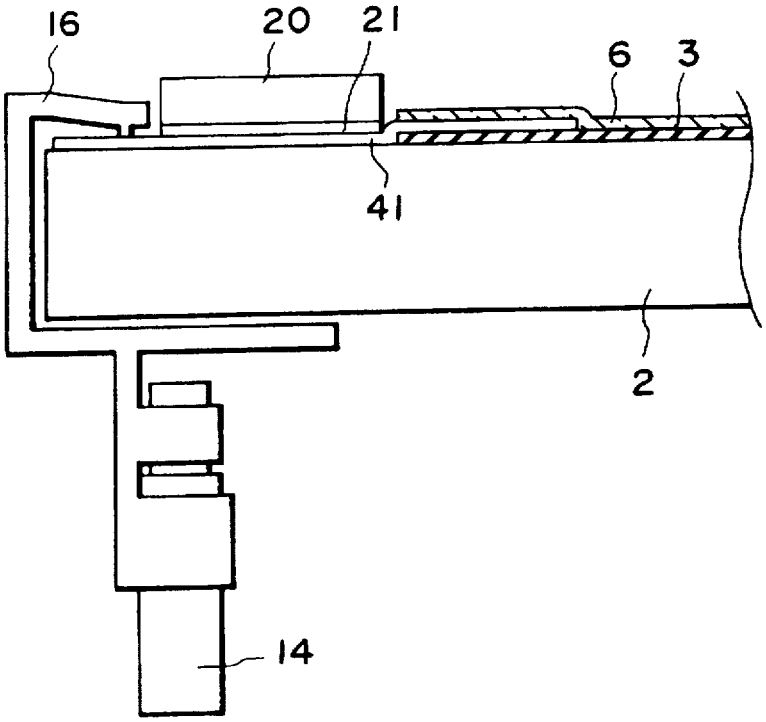
FIG. 8 is a schematic sectional view of the fifth embodiment of the present invention.

FIG. 8 is a schematic sectional layer of the fifth embodiment. In this drawing, a reference numeral 2 designates a ceramic base plate; 3, a heat generating resistor of Ag/Pd; 41, a contact layer of Ag/Pt; 42, a conductive layer of Ag; 6, an overcoat layer of glass; 14, a wire; 16, a connector contact (springy metal); 20, a metallic plate of Cu; and a reference numeral 21 designates an electrically conductive adhesive. The connector housing and heater holder are omitted from the drawing for the sake of simplicity.

In this embodiment, the heater is formed in the prior manner, and the electrically conductive adhesive 21 is coated on the surface of the terminal electrode, where its presence does not interfere with the connector contact 16, and then, on top of this adhesive layer 21, a Cu plate 20 having a higher conductivity (its surface is plated with Ag or Ni in order to prevent oxidation) is pasted. Lastly, the conductive adhesive 21 is cured by heat.

If this embodiment is applied to form the terminal electrode, it is not necessary to print the multiple layers as described in the preceding embodiments to form the conductive layers. Therefore, the manufacturing cost can be greatly reduced. In addition, the thickness of the metallic plate is approximately 0.1 mm, which is equivalent to the thickness gained by approximately 10 times of printing processes. Therefore, the resistance value is expected to be substantially reduced.

Embodiment 6

Figure 9:
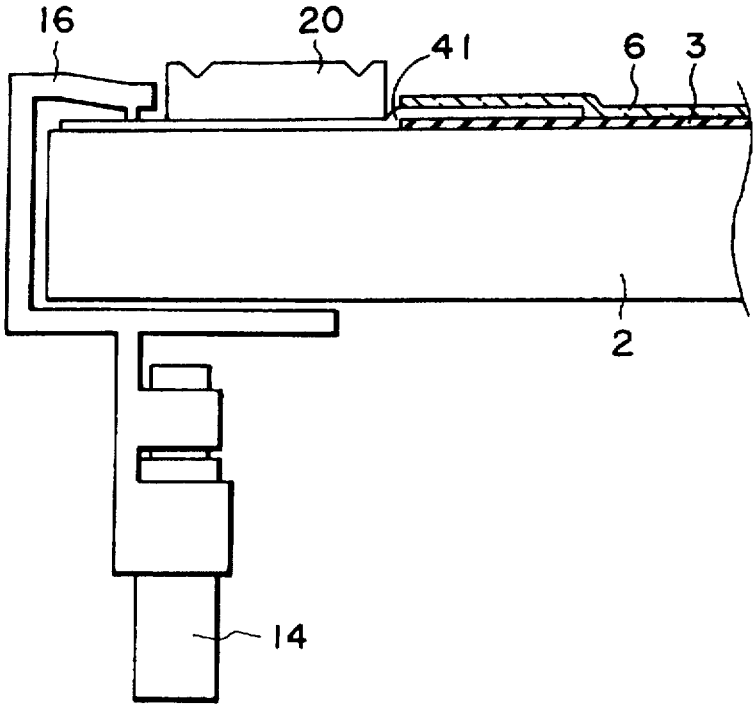
FIG. 9 is a schematic sectional view of the sixth embodiment of the present invention.

FIG. 9 is a schematic sectional view of the sixth embodiment. In this drawing, a reference numeral 2 designates a ceramic base plate; 3, a heat generating resistor of Ag/Pd; 41, a contact layer of Ag/Pt; 42, a conductive layer of Ag; 6, an overcoat layer of glass; 14, a wire; 16, a connector contact (springy metal); and a reference numeral 20 designates a metallic plate of Cu. The connector housing and heater holder are omitted from the drawing for the sake of simplicity.

In this embodiment, the metallic plate 20 of Cu, surface of which is plated with Ag or Ni to prevent oxidation, is spot welded on the terminal electrode, where its presence does not interfere with the connector contact 16. This metallic plate 20 serves as the conductive layer.

While the invention has been described with reference to the embodiments of the present invention, it is not confined to the details set forth, and this application is intended to cover such modifications or changes as may come within the purposes of the improvements or the scope of the following claims.

What is claimed is:

1. An image heating apparatus comprising:

a heater comprising an electrically insulating base plate, an electrically resistive layer, on said base plate, for generating heat when supplied with electrical power, and a terminal electrode for connection with said resistive layer, comprising a silver alloy layer, and a conductive layer having a lower resistance value than said silver alloy layer;

wherein said silver alloy layer is provided on said conductive layer to protect said conductive layer;

a film for transmitting the heat from said heater to heat an image on a recording material while being moved together with the recording material, sliding on said heater; and a power supply connector press-contacted to said silver alloy layer with a predetermined contact pressure.

2. An image heating apparatus according to claim 1, wherein said power supply connector is disconnectable.

3. An image heating apparatus according to claim 1, wherein said power supply connector is out of contact with said conductive layer.

4. An image heating apparatus according to claim 1, wherein said conductive layer is made of silver.

5. An image heating apparatus according to claim 1, wherein said silver alloy layer has a hardness higher than that of said conductive layer.

6. An image heating apparatus according to claim 1, wherein said electrode and connector are provided at each end of said base plate.

7. An image heating apparatus according to claim 1, wherein said connector comprises an electrically conductive spring, and said conductive spring contacts said silver alloy layer.

8. An image heating apparatus according to claim 1, wherein said silver alloy layer is of Ag/Pt.

9. A heater comprising:

an electrically insulating base plate;

a resistor, on said base plate, for generating heat when supplied with electrical power;

an electrode for supplying the power to said resistor;

wherein said electrode comprises a silver alloy layer and a conductive layer having a resistance value lower than that of said silver alloy layer;

wherein said conductive layer is provided on said base plate, and said silver alloy layer is formed on a side of said conductive layer remote from said base plate.

10. A heater according to claim 9, wherein said conductive layer is made of silver.

11. A heater according to claim 9, wherein said silver alloy layer has a hardness higher than that of said conductive layer.

12. A heater according to claim 9, wherein said electrode is provided at each end of said base plate.

13. A heater according to claim 9, wherein said silver alloy layer is of Ag/Pt.

* * * * *

UNITED STATES PATENT AND TRADEMARK OFFICE

CERTIFICATE OF CORRECTION

PATENT NO. : 5,753,889

DATED : May 19, 1998

INVENTOR(S) : Hiroshi KONDO, et al.

It is certified that error appears in the above-identified patent and that said Letters Patent is hereby corrected as shown below:

ON THE COVER PAGE

[57] ABSTRACT:

Line 1, "heater includes" should read --heater,--; and
Line 3, "layer," should read --layer--.

IN THE DISCLOSURE

COLUMN 1:

Line 40, "surface." should read --surface; and--.

COLUMN 2:

Line 33, "changes" should read --changed--.

COLUMN 3:

Line 55, "an" should read --a--.

COLUMN 5:

Line 46, "portion" should read --portion of--.

UNITED STATES PATENT AND TRADEMARK OFFICE

CERTIFICATE OF CORRECTION

PATENT NO. : 5,753,889

DATED : May 19, 1998

INVENTOR(S) : Hiroshi KONDO, et al.

It is certified that error appears in the above-identified patent and that said Letters Patent is hereby corrected as shown below:

COLUMN 6:

Line 15, "structure" should read --structured--.

Signed and Sealed this

Second Day of February, 1999

*Attest:*

*Attesting Officer*

*Acting Commissioner of Patents and Trademarks*